US006684528B1

(12) United States Patent
Morrison

(10) Patent No.: US 6,684,528 B1
(45) **Date of Patent: *Feb. 3, 2004**

(54) PAINT DRYING SYSTEM

(76) Inventor: Neil Morrison, 32 Greenview Drive, Rochdale OL11 54Q (GB)

( * ) Notice: Subject to any disclaimer, the term of this patent is extended or adjusted under 35 U.S.C. 154(b) by 0 days.

This patent is subject to a terminal disclaimer.

(21) Appl. No.: 10/031,247

(22) PCT Filed: Apr. 25, 2000

(86) PCT No.: PCT/GB00/01605

§ 371 (c)(1),
(2), (4) Date: Apr. 9, 2002

(87) PCT Pub. No.: WO01/07852

PCT Pub. Date: Feb. 1, 2001

(30) Foreign Application Priority Data

Apr. 21, 1999 (GB) ..... 9909088
Jul. 23, 1999 (GB) ..... 9917297

(51) Int. Cl.[7] ..... F26B 25/06
(52) U.S. Cl. ..... 34/666; 34/218
(58) Field of Search ..... 34/246, 272, 443, 34/487, 666, 202, 210, 218

(56) References Cited

U.S. PATENT DOCUMENTS

| | | | | | |
|---|---|---|---|---|---|
| 4,258,408 | A | | 3/1981 | Cantelli | 361/213 |
| 4,416,068 | A | * | 11/1983 | Nilsson et al. | 34/267 |
| 5,050,316 | A | | 9/1991 | Aigo | 34/58 |
| 5,113,600 | A | * | 5/1992 | Telchuk | 34/90 |
| 5,144,754 | A | * | 9/1992 | Persson | 34/491 |
| 5,199,189 | A | * | 4/1993 | Bourgoine et al. | 34/186 |
| 5,282,145 | A | * | 1/1994 | Lipson et al. | 700/208 |
| 5,397,606 | A | * | 3/1995 | Jeffs | 427/542 |
| 5,398,425 | A | * | 3/1995 | Cherry et al. | 34/270 |
| 5,456,023 | A | * | 10/1995 | Farnan | 34/270 |
| 5,568,692 | A | * | 10/1996 | Crompton et al. | 34/270 |
| 5,718,061 | A | * | 2/1998 | Scheufler et al. | 34/475 |
| 5,836,085 | A | * | 11/1998 | Ben-Ezra | 34/270 |
| 6,192,604 | B1 | * | 2/2001 | Morrison | 34/666 |

FOREIGN PATENT DOCUMENTS

| | | | | |
|---|---|---|---|---|
| DE | 29 10 232 A1 | | 3/1979 | |
| DE | 39 20 069 A1 | | 6/1989 | |
| DE | 42 37 462 A | | 5/1994 | |
| EP | 95201023.9 | | 4/1995 | |
| JP | 61002316 | | 6/1984 | |
| JP | 08084948 | | 9/1994 | |
| JP | 07299412 A | * | 11/1995 | B05D/3/14 |
| JP | 08084948 A | * | 4/1996 | B05B/15/12 |
| WO | WO/9508745 | | 3/1995 | |
| WO | WO/9835195 | | 8/1998 | |

* cited by examiner

*Primary Examiner*—Ira S. Lazarus
*Assistant Examiner*—Andrea M. Ragonese
(74) *Attorney, Agent, or Firm*—Durando Birdwell & Janke, PLC

(57) ABSTRACT

A paint drying system for drying a painted body (4), such as a painted motor vehicle, includes a spraybooth (1) having an enclosure (2) through which air flows from an air inlet (6) to an air outlet (16, 18). The spraybooth (1) may also have columns of air jets (34) mounted in respective corners of the enclosure (2) to direct air obliquely at surfaces of the vehicle body (4). The system includes ionization members (33) for electrically charging this air supply. In a preferred embodiment the air is negatively charged by ionization members comprising one or elongate rods (33) mounted parallel with the columns of air jets (34). The spraybooth (2) may also have a control system (210) for controlling the paint drying system (4). The control system (210) has user-operable controls (234) to pre-select a predetermined parameter/combination of parameters and thus control the characteristics of a respective drying stage or cycle which parameters, e.g. temperature, vary with time.

8 Claims, 7 Drawing Sheets

PAINT DRYING SYSTEM

TECHNICAL FIELD

The invention relates to a paint drying system for painted bodies, and particularly, but not exclusively, a system for drying painted motor vehicles.

BACKGROUND ART

Conventional automobile spraybooths dry solvent-borne paints which have been applied onto the surfaces of a motor vehicle by passing heated air over the painted surface. Typically, heated air is blown into the spraybooth through inlets e.g. in the booth ceiling and is evacuated through floor outlets.

The surfaces of the bodies such as motor vehicles and particularly non-conductive components such as plastic bumpers, are normally found to be electro-statically charged. This electrostatic charge results from normal handling of the body prior to painting and is generally unavoidable.

The electrostatically charged surfaces of the vehicle attract dirt and dust particles and this results in contamination of the painted surface.

In an attempt to reduce such contamination, the surface is typically degreased and "tacked off" (rubbed using what is commonly referred to as a "tack rag") prior to painting. However, this can be counter-productive as the rubbing action greatly increases the static charge on the surface. Loose/airborne particles originating from tack cloths, operator clothing etc., are then attracted to the surface.

Paint is typically applied to motor vehicles using a spray gun. When the paint is atomised from the spray gun, this also acquires a static charge which attracts dirt and dust particles.

The result is that the painted surface is often contaminated by dust/dirt particles and although the painting process is designed for a "gun finish" without subsequent polishing, refinishing work is often necessary involving many wasted hours of removing dirt ingressed during painting which reduces the cost effectiveness of the painting operation.

A further problem is that metallic paint finishes make up approximately 50% of car colours currently on the road. Mica or aluminium is used to produce the metallic finish and is disturbed by static charge which can result in a patchy surface and colour inaccuracy.

DISCLOSURE OF THE INVENTION

It is, therefore, an object of this invention to provide a system for drying a painted body which eliminates or, at least, reduces contamination by dust and particles of the painted surface, thereby eliminating or, at least, reducing the need for refinishing operations.

According to the invention therefore there is provided a paint drying system for drying a painted body, the system comprising a spraybooth having an enclosure, an air inlet, an air outlet and means to supply air to the inlet to flow through the enclosure from the inlet to the outlet, characterised by the provision of means for electrically charging the said air supply.

With this arrangement any static charge on the body surfaces or on particles present on the surfaces is neutralised by ions in the air supplied, thereby eliminating or, at least reducing contamination of painted surfaces and eliminates or reduces the need for refinishing operations which would otherwise reduce the cost effectiveness of the operation.

A further, somewhat surprising effect, which has been noted is a reduction by 20% in drying times of painted motor vehicles.

Furthermore, it has been found that dust and dirt particles are predominantly positively charged.

Thus, preferably the supply air is negatively charged. The negative ions produced neutralise any positively charged particles present on the panel thereby neutralising the attractive forces between the charged contaminants and the panel so that the contaminants are then easily blown off the surface by the air flow through the booth and subsequently removed via the air outlet.

However, it is not intended that the invention is to be restricted to the negative ionisation, and it is envisaged that positive ionisation may be provided, if desired, for example, to neutralise contaminants found to be negatively charged.

The means for electrically charging the air inlet supply to the enclosure may take any suitable form however and this preferably comprises at least one ionisation member operable to be electrically charged by, for example, appropriate electrical coupling to a voltage supply.

The each ionisation member preferably comprises a conductive material e.g. metal.

Alternative forms of air charging means may be used, however, the advantage of using a high voltage charging device is that this type of device is not regulated by stringent legislation and is fairly easy and inexpensive to obtain. Furthermore, a high voltage charging device can be safely used whilst operators are inside the enclosure.

The spraybooth may take any suitable form but, preferably, the means to supply air to the inlet comprises a pump/pumps, which preferably are operable to supply air from the atmosphere externally of the booth to the air inlet. Preferably, also the spraybooth incorporates a heater for heating the inlet air.

Alternatively, air may be re-circulated from within the enclosure, or from a plenum chamber of the inlet or outlet air system.

The air inlet may take any suitable form and may include a duct/duct system which is connected to the enclosure at one or more openings in the enclosure walls or ceilings etc. so as to supply air into the enclosure.

The spraybooth may have at least one further air inlet which may receive air from the atmosphere externally of the booth and direct this air into the enclosure transversely of the said airflow.

Alternatively, this air may be re-circulated from the enclosure to the further air inlet.

This air inlet may comprise air nozzles or jets which are mounted internally of the enclosure and are operable to direct air obliquely at surfaces of the body.

The air nozzles/jets may be mounted on a housing or support structure which is mounted internally of the enclosure.

Compressed air may be supplied to the air inlet and/or the further air inlet by means of an air compression device.

The or each ionisation member may be located in any suitable position. However, preferably the or each ionisation member is mounted internally of the enclosure and particularly, preferably, directly in the path of the air flow into the enclosure, from the air inlet and/or the further air inlet.

To this end, the ionisation member may be mounted on an internal structure of the enclosure e.g. wall, ceiling, etc., and preferably adjacent e.g., so as to straddle the or each enclosure opening.

With this arrangement, ions produced by the or each ionisation member may be distributed to the body surfaces by the said air flow (from the inlet).

However, the invention is not intended to be restricted to mounting of the ionisation member within the enclosure. Alternatively, the ionisation member may be located at any suitable position within the air inlet and/or the further air inlet.

Where the spraybooth incorporates a further air inlet, as mentioned above, the or each or any ionisation member may be attached to, or adjacent, the further air inlet, so as to position the member directly in the path or the air flow from the nozzles/jets into the enclosure. Alternatively, there may be one or more ionisation members within or adjacent each jet or nozzle.

The or each further air inlet may include doors which, in a closed position, are operable to shield or enclose the nozzles or jets when not in use e.g. during painting so as to prevent contamination of the nozzles/jets by airborne paint particles.

The or each ionisation member may be located so as to be shielded or enclosed by the doors when in a closed position.

The or each ionisation member may be mounted so as to be positionally adjustable.

The or each ionisation member may have any suitable structure, and may be an elongate bar or rod or a grid/grill structure.

Preferably, the or each further air inlet comprises one or more parallel columns of nozzles/jets and there is one ionisation member consisting an elongate metal rod which is mounted generally parallel with the said columns.

The ionisation member may be integral to the spraybooth so that part of the spraybooth is electrically charged.

Advantageously, the paint drying system may also be used for drying a body painted with a water-based paint.

The body may be any suitable body, but preferably, it is a motor vehicle.

A further problem concerns a control system for controlling a paint drying system.

Conventional automobile paint drying systems comprise a spraybooth in which the motor vehicle body is first painted and then dried (or 'baked'). The temperature at which the painted body must be dried and the drying time is critically dependent upon the type of paint which has been applied and the paint surface finish required.

Spraybooth drying times are generally the most important factor within a busy paint spraying workshop. Each paint product has optimum drying temperature time (collectively referred to as a drying cycle) both in terms of speed and quality. The same applies to paint manufacturers as a paint product as one company may benefit from different temperature profile to that of another manufacturer.

Spraybooth operator errors in setting the temperature and time of the drying process can mean that the paint is not dried sufficiently, and in this case, the drying process must be repeated in its entirety. Such errors may expensively reduce the number of painted bodies which may be dried and so reduce the cost effectiveness of the paint drying operation.

A further object of the present invention is to provide a control system which eliminates or reduces operator error.

According to a further aspect the invention therefore, there is provided a control system for controlling a paint drying system for drying a painted body, the control system including at least one user-operable control, the or each user operable control being operable to preselect a predetermined parameter or predetermined combination of parameters.

With this arrangement the paint drying system can be operated in a quick and efficient manner, increasing the throughput of the paint drying system and, at the same time because individual setting of the various system parameters is not necessary, there is less risk of user error when operating the paint drying system.

The painted body is preferably a motor vehicle, e.g. a motor car. However the invention may also advantageously used for drying other painted bodies such as aircraft bodies, watercraft bodies etc.

The paint drying system may include a spraybooth which may have an enclosure in which the painted body is dried. The spraybooth may have an air inlet and air outlet, and pump means to supply air from atmosphere externally of the spraybooth to the air inlet to flow through the enclosure from the air inlet to the air outlet. Preferably, the spray booth incorporates a heater for heating the inlet air.

The or each user-operable control may be operable to preselect a single predetermined parameter, such as temperature.

However, the or each user-operable control may be operable to control any number and combination of system parameters, such as inlet air flow rate, temperature, pressure, humidity, spraybooth enclosure temperature, pressure, humidity, etc.

The control system may incorporate sensors for sensing paint drying system operating parameter values, such a enclosure temperature, pressure, inlet flow rate etc., so that such parameter values can be monitored and regulated by the control system.

Preferably, the or each user-operable control is operable to preselect at least two predetermined parameters, wherein one of such parameters is a time and/or temperature related parameter.

Most preferably, the or each user-operable control is operable to control the characteristics of a respective drying stage or cycle in which a parameter such a temperature, or combination of parameters vary with time.

The spraybooth may have at least one further air inlet which receives air from the atmosphere externally of the booth and directs this air into the enclosure transversely to said air flow.

This air inlet may comprise air nozzles or jets which are mounted internally of the enclosure and are operable to direct air obliquely at surfaces of the motor vehicle.

Accordingly, the user-operable control may be operable to preselect system parameters associated with the further air inlet airflow, such as air flow rate, temperature, pressure, humidity etc.

The predetermined parameters which are preselected by the or each user-operable control may vary with respect to time, such that the parameter values vary during a particular drying stage or cycle. For instance, a parameter may increase/decrease incrementally throughout the drying cycle or part of the cycle, or there may be one or more ramped increase/decrease(s) during a cycle.

In a preferred embodiment there are a plurality of user-operable controls, each control being operable to preselect the parameters of an associated drying cycle, such that a plurality of drying cycles may be provided for.

The or each user operable control may take any suitable form and may comprise a button, key, switch, touch/heat/photo-sensitive display screen etc.

Preferably, the control system incorporates an electronic control unit such as programmable controller or a microprocessor based unit and may further incorporate a data storage (memory) unit so that the parameter values may be stored.

Preferably the control unit is pre-programmable so that the system parameters for the or each drying cycle of the system may be pre-programmed, by , for example, the spraybooth proprietor, or manufacturer.

Accordingly, the control unit may include a data entry device such as a keypad or keyboard and further preferably a date entry display device to enable viewing of entered programming data during and/or after pre-programming.

The control system may incorporate a display device to display the parameter settings of a particular drying cycle. This display device may be operative to display the parameter settings either on demand and/or during a drying cycle.

The or each display may comprise any suitable form but preferably incorporates a digital display. There may be a separate display for each of the above functions or alternatively, and preferably there is a single, multi-functional display device operative to display parameter values during pre-programming and during a drying cycle.

Preferably, the control system includes a housing which houses the above described control system components. The housing may take any suitable form such as a metal or plastic box construction.

The housing may be attached or integral to the spraybooth, but preferably, it provides for electrical/pneumatic/hydraulic coupling of the control system to corresponding spraybooth components as is required e.g. an electric coupling between the or each heater, a spraybooth thermo-sensor and the control housing for effecting enclosure temperature control; a pneumatic coupling between a pressure sensor in the enclosure interior and the control housing and any of the spraybooth flow rate devices (pumps, fans, flow dampers etc.) for effecting control of the pressure of the enclosure etc.

Preferably, the user operable components of the control system including the user operable control(s), data entry device(s) and any display device(s) alarms etc., are mounted so as to be accessible by a user/operator when outside of the enclosure.

Advantageously, these user operable components mentioned above are mounted on a panel which may be incorporated into the above described housing.

BRIEF DESCRIPTION OF THE DRAWINGS

The invention will be described by way of example and with reference to the accompany drawings in which.

DESCRIPTION OF THE PREFERRED EMBODIMENTS

Figure 1:
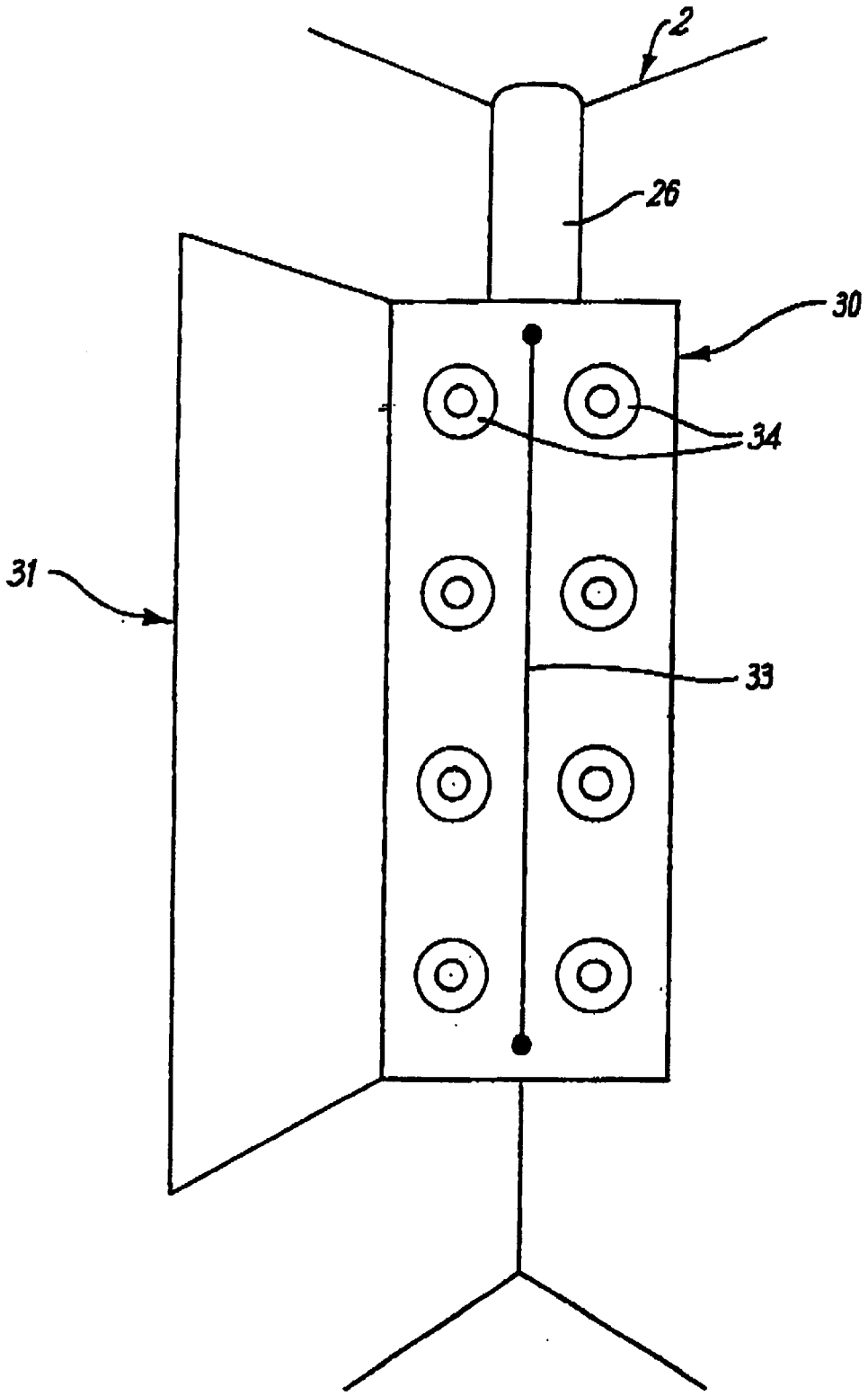
FIG. 1 is a diagrammatic representation of part of a paint drying system according to one form of the present invention, showing an ionisation member.
Figure 2:
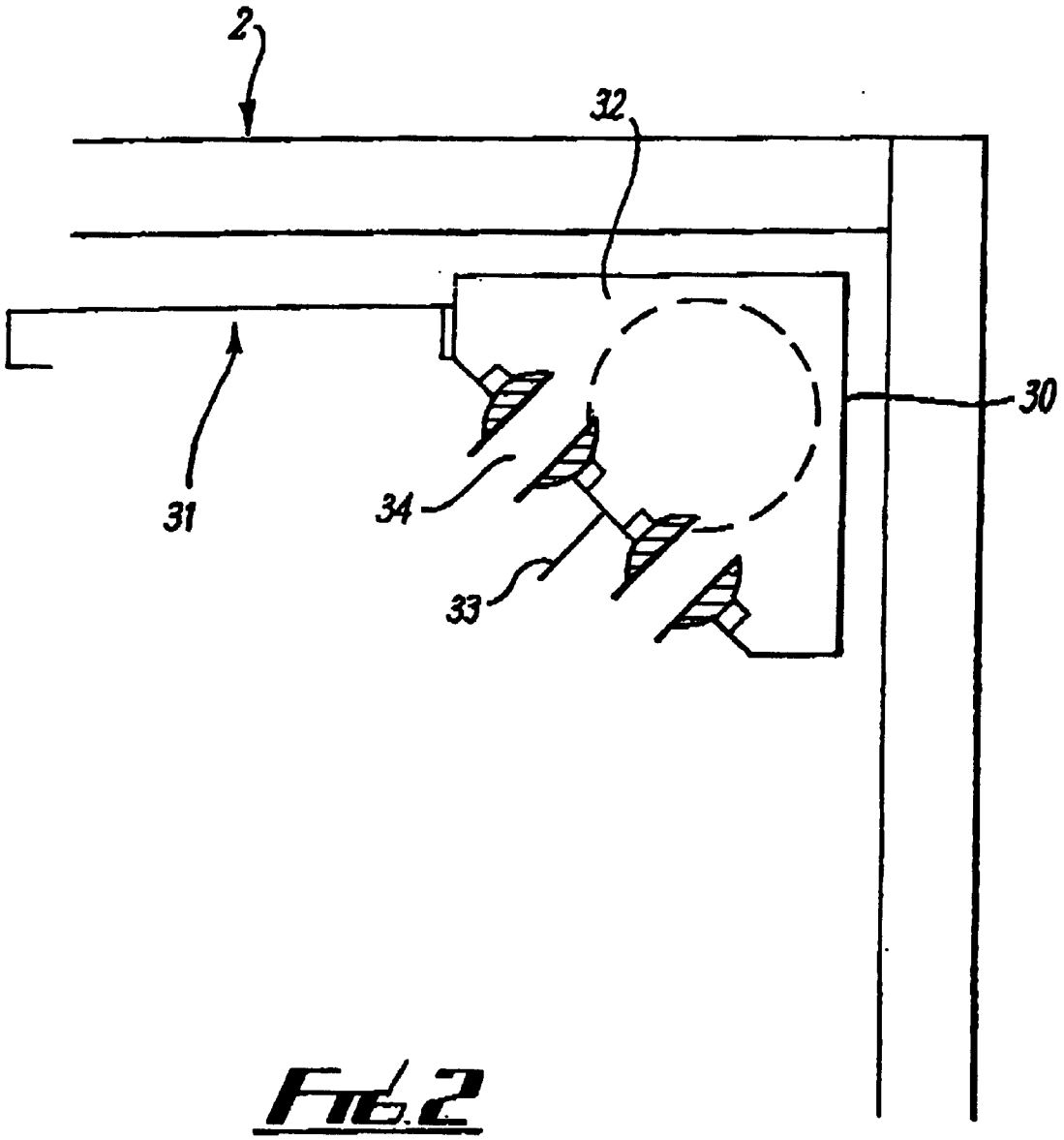
FIG. 2 is a plan view of the ionisation member of FIG. 1

Referring to the drawings, a paint drying system is used for drying a painter motor car.

The paint drying system comprises a spraybooth 1 which has an enclosure 2 of generally rectangular box construction in which the vehicle 4 (only shown in FIG. 3) is first painted and then dried and/or baked.

The spraybooth 1 incorporates an air inlet system 6 and an air outlet system 8 such that air flows under the action of pumps 10, from the atmosphere, externally of the spraybooth 1, into the enclosure 2. The air inlet system 6 incorporates ducting 26 and a plenum chamber 28 through which inlet air passes to the enclosure 2.

The spraybooth 1 has a re-circulation duct 12 which connects the inlet and outlet ducts (by means of a damper) during baking of the painted vehicle so as to provide re-circulation of 90% of spraybooth air—thereby increasing the temperature of the enclosure during baking. This air flow is enhanced by a number of pumps and fans.

The air inlet further incorporates a gas-fired air heater 14 for preheating the inlet air. (Alternatively, this could be an oil-fired heater).

The air outlet of the spraybooth comprises a grid 16 in the enclosure base which leads via ducting 18 to the atmosphere external of the booth. This duct incorporates an air flow damper (not shown) which can be closed to restrict air flow from the enclosure. If air flow into the chamber is maintained whilst the damper is in the closed position, the internal pressure of the enclosure increases above atmospheric pressure. Similarly, when the damper is in the open position, the enclosure may be negatively pressurised by adjusting the flow rate of air into the booth.

The spraybooth incorporates main doors 20 for vehicular access and operator access doors 22.

The system incorporates a control system (described in detail hereinbelow) which is operable to remotely control the parameters: time, temperature and pressure of the various (eight) drying cycles (in which all the air flowing through the enclosure is from the atmosphere, externally of the booth) and the bake cycle (in which the air is re-circulated as described above).

The spraybooth 1 incorporates a further air inlet comprising four corner units 30, the unit 30 being mounted internally of the enclosure 2 in the respective four corners thereof.

Each unit 30 has a triangular body in the form of an elongate shell of triangular cross section mounted upright in a corresponding enclosure corner unit 30.

Figure 3:
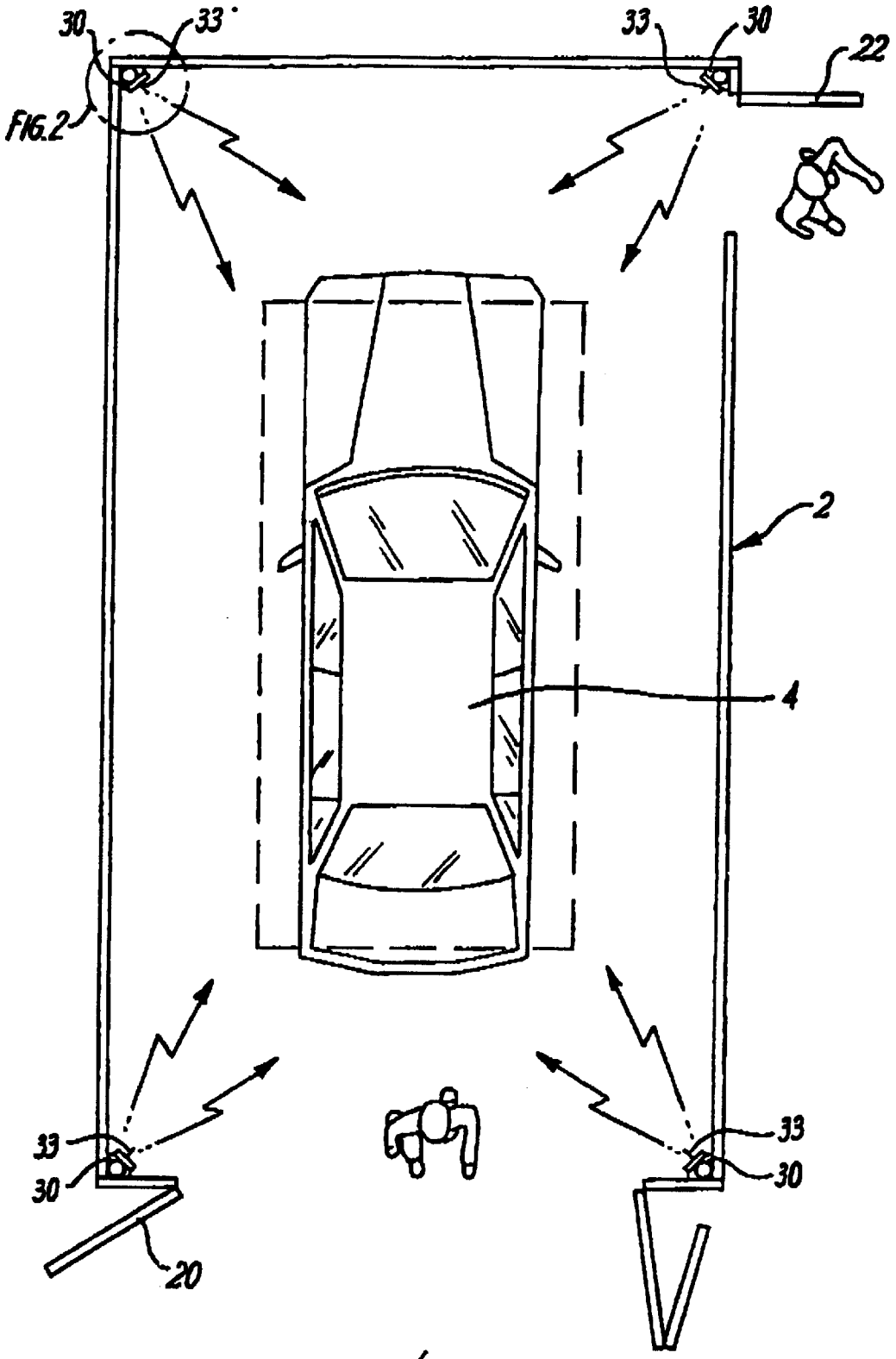
FIG. 3 is a plan view of the paint drying system of FIG. 1
Figure 4:
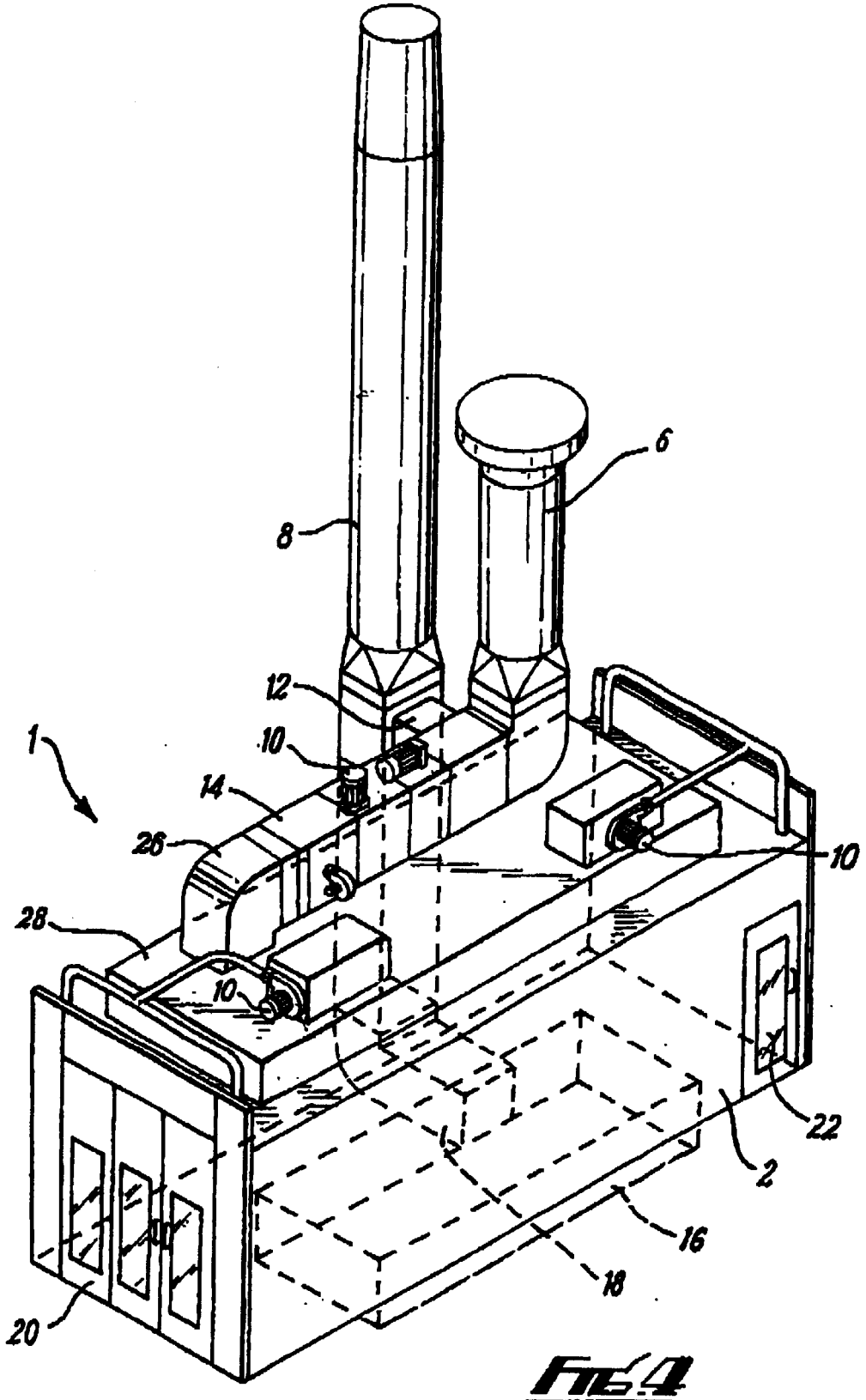
FIG. 4 is a perspective view of the paint drying system of FIG. 1.

Each unit 30 has an internal passageway 32 which is connected to the air inlet system ducting 26, and has two columns of four spaced apart vertically aligned air jets 34 which are directed obliquely at the surfaces of the car 4. (As shown in FIG. 3). The two lowermost jets are 300 mm from the base of the enclosure and the distance between adjacent vertically aligned jets is 300 mm.

Each corner unit 30 has a door 31 which can be pneumatically and remotely operated between an open position as shown, and a closed position in which the air jets 34 are enclosed (for use during paint spraying operations).

The further air inlet also incorporates four ionisation members 33 each comprising an elongate metal rod 1100 mm in length and which is electrically coupled to a high voltage supply consisting of an AC power unit (not shown), controlled by an electrical control unit (not shown) and coupled to a coil which is connected to the bars 33 by high tension leads (not shown). The control unit is integrated into the spraybooth control system (not shown) so that operation of the ionisation member can be remotely controlled.

The ionisation members 33 are mounted upright on the corner units in between the two columns of air jets 34.

The ionisation members 33 are operable to emit ions within a range of approximately 100 mm (in static air conditions).

The ionisation members 33 are mounted so that, as with the jets 34, they are exposed with doors 31 open and enclosed with the doors 31 shut.

Dual speed motors (alternatively air volume dampers) are fitted to the corner units to reduce the velocity of the air flowing through the jets on the bake cycle—high air velocities can damage the wet paint finish.

In use the doors 31 are open and the heated air is pumped to flow from the atmosphere externally of the booth, through the air inlet ducting 26 (and plenum chamber 28) into an inlet in the ceiling of the enclosure 2 and to the corner mounted jets 34.

The air from the jets enters the enclosure transversely to the air entering via the ceiling, and directs the air obliquely at the external surfaces of the painted motor vehicle.

The ionised bars 33 are then electrically charged to negatively charge air flowing into the chamber from the air jets. (opening of the doors is a control system requirement for charging of the bars 33).

The air flow distributes the ions on to the surfaces of the motor vehicle thereby neutralising any positively charged dirt/dust on the surfaces. Statically neutralised, the dirt and dust is no longer attracted to the surfaces and blown away and extracted via the outlet system.

Paint is generally applied to a motor vehicle in a number of layers. Advantageously the anti-static ionisation bars 33 are used throughout the process i.e. during initial preparation prior to painting of the vehicle within the spraybooth and a primer paint baking cycle, during a waterborne paint drying cycle and on a final laquer coat or solid colour baking cycle.

This ensures that static charge is continuously neutralised for quality of finish and cleanliness but also the process baking times are, surprisingly, reduced by approximately 20%.

The corner unit with ionisation bars may, together, with a modified control system, be retrofitted into existing e.g. standard downdraft spraybooths.

The above paint drying system provides an automated statically neutralised paint drying system for the motor vehicle refinishing industry. This eliminates the need for refinishing after drying.

Figure 5:
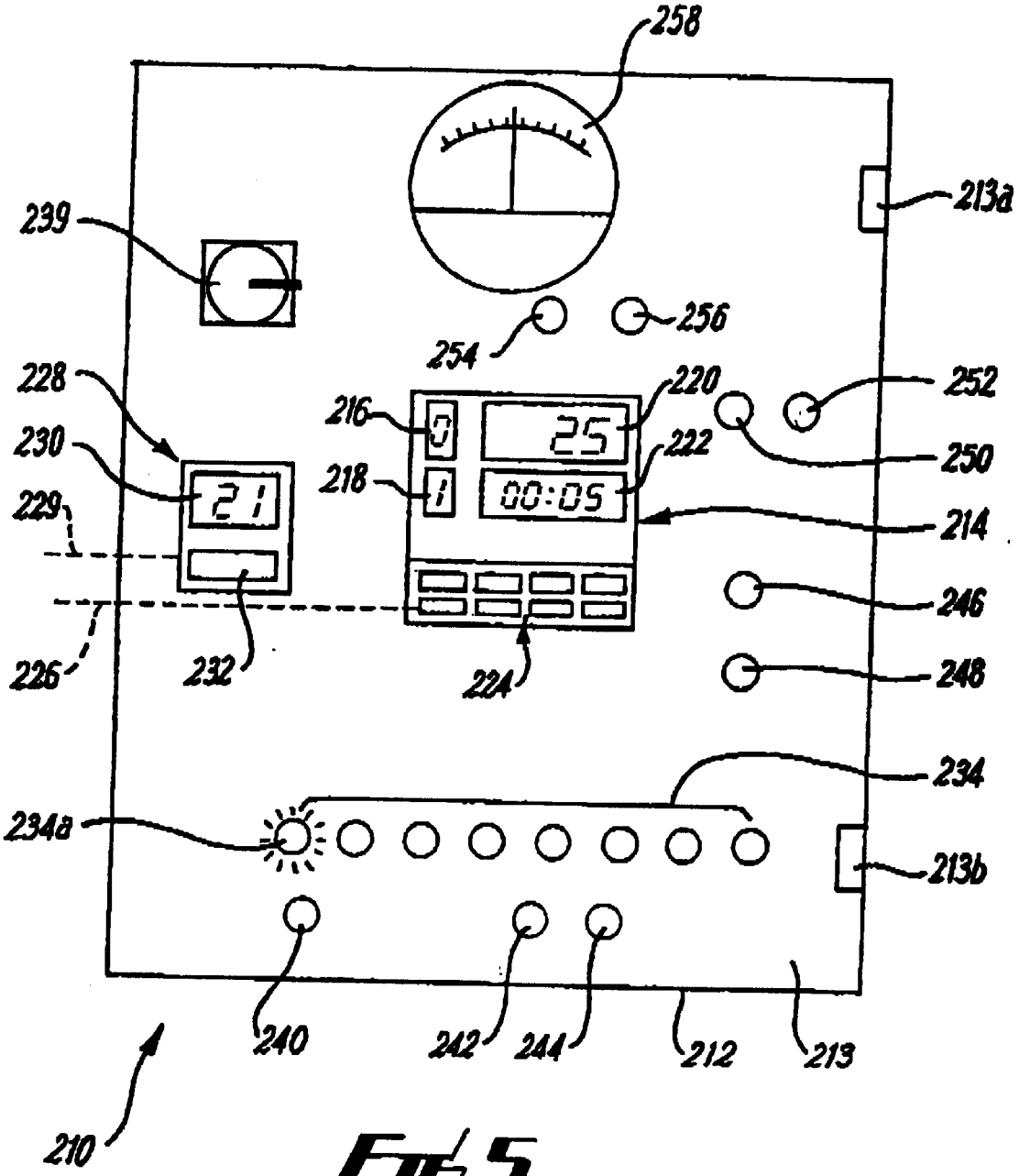
FIG. 5 is a diagrammatic representation of a control system of the present invention.
Figure 6A:
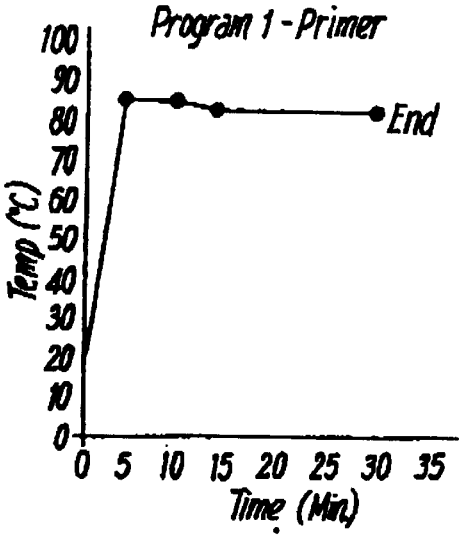
FIGS. 6*a*–6*h* are typical temperature profiles of drying cycles of the paint drying system of FIG. 1.
Figure 6B:
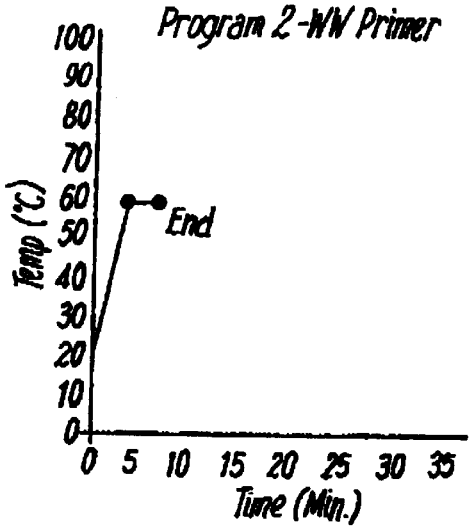
Figure 6C:
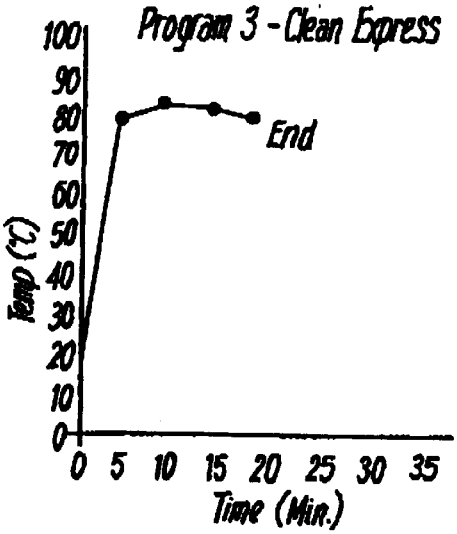
Figure 6D:
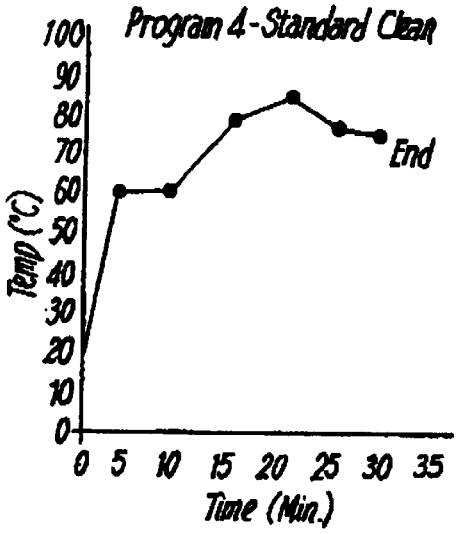
Figure 6E:
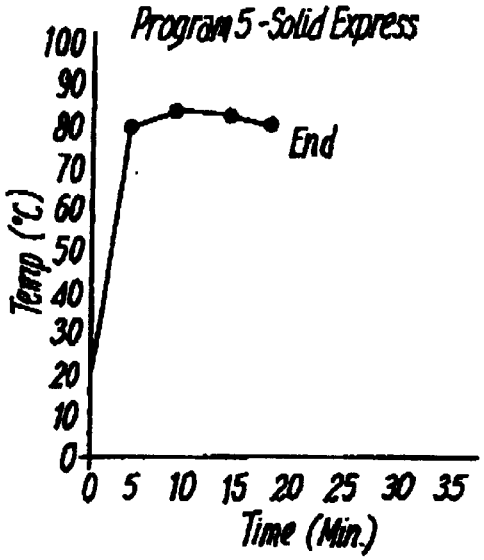
Figure 6F:
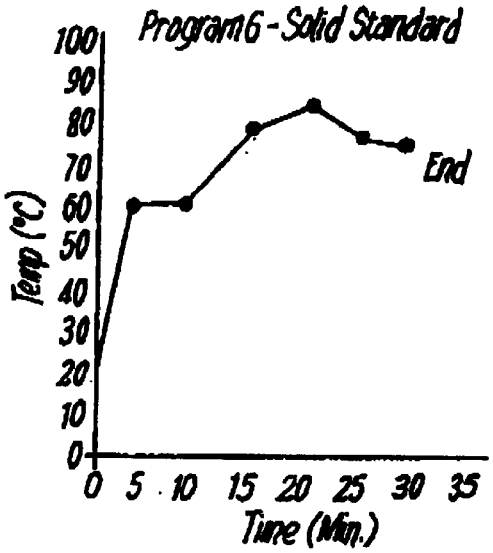
Figure 6G:
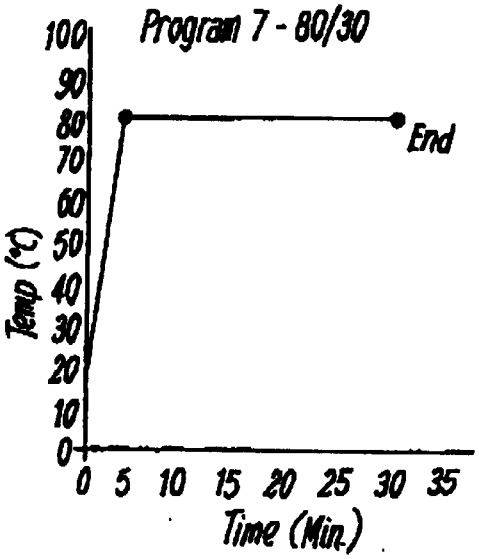
Figure 6H:
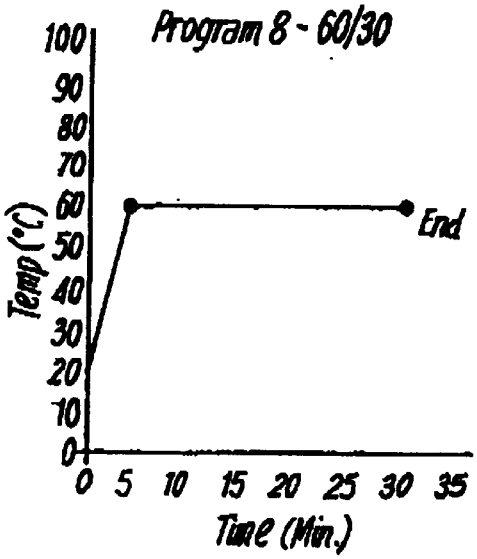

Referring to FIG. 5, the control system 210 is used to control a paint drying system is used for drying a painted motor car. The paint drying system comprises a spraybooth 1 which has an enclosure 2 of generally rectangular box construction in which the vehicle (not shown) is first painted and then dried and/or baked.

The control system comprises a housing 212 which is a metal rectangular box construction and is secured to one of the upright external walls of the enclosure so as to be accessible to an operator when he/she is outside of the enclosure. The housing incorporates a front panel 213 hinged to the housing by hinges 213*a* and 213*b*. This panel 213 conveniently locates all user-operable components and display devices as described below.

The housing incorporates a 'bake mode' electronic temperature control device 214 comprising an digital programmable controller with a data storage device (not shown), four digital display screens 216,218,220, 222 and a data-entry keypad 224.

A thermocouple (not shown) is installed in the spraybooth enclosure and is operable to measure the temperature of the enclosure and connected to the device (the connection being indicated by the dashed line 226) so as to transmit temperature readings to the controller. The controller 214 is also connected to the heater so as to be operable to control the heater. The device is thereby, by means of a simple closed loop control system operable to control the temperature of the enclosure.

The housing also incorporates a second simplified 'spray mode' temperature controller 228 which is constructed as for the 'bake mode' controller, with similar connections (indicated by dashed line 229) to heating devices as described for the 'bake mode' controller above, excepting it has a single display 230 and a simplified keypad 232.

The housing incorporates eight user-operable control push-buttons 234. Each of the buttons 234 is connected to input terminals of the temperature controller via relay switches so that when activated, each button connects to a respective pair of bake controller input terminals so that each button can provide a different input signal to the controller. Each button is identified by the controller by a respective one of numbers 0–7. The buttons 234 each include a respective lamp which illuminates when the button 234 is depressed.

The control housing also incorporates other standard control buttons: an on/off button 239 connects the internal circuitry of the control housing to the mains power supply; a reset button 240 is operative to cancel the previous selection of user-operable control button; bake mode start and stop buttons 242 and 244 start and stop the selected drying process; spray mode start and stop buttons 246 and 248 start and stop the spraying process. There is also an enclosure lighting controller button 250 and a heater alarm 252 which can be used to shut off the gas heaters of the air input (or oil-fired heaters as the case may be).

The control system also includes pressure regulatory controllers. A pressure balance controller button 254 is connected to the air outlet damper so that the spraybooth enclosure pressure can be positively or negatively pressurised. A over pressure control 256 is operable to shut the entire paint drying system down if the pressure inside the booth exceeds a set level. Both controls 254 and 256 are connected to an enclosure pressure sensing device (not shown) mounted in the spraybooth enclosure interior, and this is also connected to a pressure gauge 258 which displays current operating pressure within the enclosure.

All button except those referenced 239,250,252,254 and 256 are push buttons.

The 'bake mode' controller is used to control the time and temperature parameters of eight different drying cycles, each one having an associated user-operable controller button 234. An example of a predetermined selection of drying cycles is as follows:

1. primer—Hi build/surfacer
2. wet on wet primer
3. clear coat standard
4. clear coat express
5. solid colour standard
6. solid colour express
7. 80 deg. C for 30 minutes—Airtemp (metal)
8. 60 deg. C for 30 minutes—Airtemp (plastic)

The unit is pre-programmed by inputting the time/temperature values of each drying cycle into the memory unit via the keypad 224. During pre-programming of each drying cycle, the input values are displayed in the display regions 216–222. However, once the programming is completed the keypad may be electronically locked to prevent tampering.

Each drying cycle comprises a predetermined number of timed temperature phases or steps so that the temperature profile of the drying system changes with respect to time for each cycle (as shown more clearly in FIGS. 6*a*–6*h*).

The step number, step duration, associated enclosure temperature setting of each step are displayed in respective display regions 218,220 and 222.

The number of the associated user-operable button 234 is also displayed in the display region 216.

The 'spray mode' temperature controller is used to control the temperature within the enclosure during spraying. The temperature is set by pre-programming the controller 228

The example temperature profile graph of FIGS. 6*a*–6*h* shows a typical programme. The less sensitive products benefit from a rapid temperature rise whilst others require a slower temperature increase initially but higher temperatures towards the end of the cycle.

Standard bake time and temperature combinations are included with buttons 7 and 8 for non standard products.

Having the most efficient cure cycle saves valuable booth time and energy consumption.

The quality of cure reduces the risk of paint defects and warranty problems.

In use, the motor vehicle body is first sprayed. The operator simply presses the 'spray mode' start button 246 which initiates the spray process at the pre-programmed temperature (in this case 21 degrees centigrade). The operator then begins spraying.

When the spraying process is complete, the paint drying system is activated by pressing the user-operable control appropriate to the paint and finish required. The button is thereby illuminated and its identifying number indicated in display region 216.

Each step in the selected drying cycle is also shown in display regions 218–222: i.e. as shown in the FIG. 1, activated and illuminated button 234*a* is identified as button '0' in display region 216; the current step is identified as step '1' in region 218; the enclosure temperature of this step is identified as 25 degrees centigrade in display region 220 and the step number identified in display region 222.

The operator then depresses the 'bake mode' start button and the drying cycle is initiated. The operator has no need to select individual temperature parameters, which are particularly critical to the paint finish obtainable.

With this arrangement, the paint drying system can be operated in a quick and efficient manner, increasing the throughput of the paint drying system and, at the same time because individual setting of the various system parameters is not necessary, there is less risk of user error when. operating the paint drying system.

It is of course to be understood that the invention is not intended to be restricted to the details of the above embodiment which are described by way of example only.

What is claimed is:

1. A paint drying system for drying a painted body, the system comprising a spraybooth having an enclosure, an air inlet, an air outlet and means for supplying air to the inlet to create an airflow through the enclosure from the air inlet to the air outlet, said system further comprising:

at least one further air inlet which receives air from the atmosphere externally of the spraybooth or air re-circulated from the enclosure and directs this air into the enclosure transversely of the said airflow, wherein the further air inlet comprises air nozzles or jets mounted internally of the enclosure which are operable to direct air obliquely at surfaces of the body;

at least one ionization member for directly charging said air within the enclosure, said ionization member being mounted internally of the enclosure and directly in the path of the air flow into the enclosure from the air inlet or the further air inlet; and means for electrically charging said air supply.

2. A paint drying system according to claim 1, wherein the supply air is negatively charged.

3. A paint drying system according to claim 1, wherein the at least one ionization member is operable to be electrically charged by electrical coupling to a voltage supply.

4. A paint drying system according to claim 1, wherein the means for supplying air to the air inlet comprises a pump which is operable to supply air from the atmosphere externally of the spraybooth to the air inlet, or to re-circulate the air from within the enclosure, or from a plenum chamber of the inlet or outlet air system.

5. A paint drying system according to claim 1, wherein said at least one ionization member is attached to, or adjacent, the further air inlet, so as to position that member directly in the path of the air flow from the nozzles or jets into the enclosure.

6. A paint drying system according to claim 1, wherein said at least one further air inlet includes doors which, in a closed position, are operable to shield or enclose the nozzles or jets when not in use so as to prevent contamination of the nozzles or jets by airborne paint particles, and wherein said at least one ionization member is located so as to be shielded or enclosed by the doors when in a closed position.

7. A paint drying system according to claim 1, wherein said at least one further air inlet comprises one or more parallel columns of said nozzles or jets and said at least one ionization member consists of an elongate metal rod which is mounted generally parallel with the said columns.

8. A paint drying system according to claim 1, wherein said at least one ionization member is integral to the spraybooth so that part of the spraybooth is electrically charged.

* * * * *